United States Patent [19]

Moller

[11] 4,157,764

[45] Jun. 12, 1979

[54] EASY OPEN BEVERAGE CAN—NON-DETACH

[75] Inventor: Jens L. Moller, Darien, Ill.

[73] Assignee: The Continental Group, Inc., New York, N.Y.

[21] Appl. No.: 930,098

[22] Filed: Aug. 1, 1978

[51] Int. Cl.[2] ..... B65D 41/02

[52] U.S. Cl. ..... 220/260; 220/240; 220/281; 220/271; 220/366

[58] Field of Search ..... 220/260, 265, 268, 269, 220/306, 307, 359, 240, 271, 281, 366, DIG. 19

[56] References Cited

U.S. PATENT DOCUMENTS

| | | | |
|---|---|---|---|
| 2,254,453 | 9/1941 | Scharmett | 220/281 |
| 3,800,971 | 4/1974 | La Vista | 220/240 X |
| 4,034,888 | 7/1977 | Strauss | 220/260 |

*Primary Examiner*—George T. Hall
*Attorney, Agent, or Firm*—Charles E. Brown

[57] ABSTRACT

An easy opening beverage can wherein the closure is of the push-in type. The dispensing opening in the container is defined by a sealing ring into which there is engaged a peripheral flange of the closure member with the closure member being held initially with respect to the sealing ring only by a mechanical interlock. Pressure within the can tightly forces the closure member into sealing engagement with the sealing ring and normally prevents removal. A lever is connected to the sealing ring to effect distortion thereof and bleeding-off of pressure from within the can so as to relieve the holding pressure on the closure member, after which the closure member may be readily pushed into the can in an opening action.

12 Claims, 5 Drawing Figures

EASY OPEN BEVERAGE CAN—NON-DETACH

This invention relates in general to new and useful improvements in easy opening containers, and more particularly to an easy opening beverage container.

The most popular type of easy opening beverage container is one wherein a tear-out portion is formed, normally in the end panel, and there is attached to the tear-out portion a pull tab or lever. When the opening procedure is completed, the tear-out portion and tab become separated from the container and are generally indiscriminately discarded. Further, in the tearing out of the container panel portion, a raw edge is normally left surrounding the newly formed dispensing opening.

It is desirable that when a container is opened, no portion thereof be detachable therefrom so as to eliminate the heretofore uncontrollable indiscriminate discarding of the container components. It is also desirable that the edge of the container material defining the dispensing opening be guarded or protected so as to prevent accidental injury.

In accordance with this invention, the two aforesaid undesirable features may be readily eliminated by initially forming in the container a dispensing opening and then engaging over the container edge defining the dispensing opening a sealing ring with which a separately formed closure member is interlocked. However, a seal is required between the closure member and the sealing ring under conditions of high pressure and it is proposed to assure this by mounting the closure member from the interior of the container in such a way that the pressure within the container reacting on the closure member will tightly force the closure member into sealing engagement with the sealing ring. The mounting of the closure member within the interior of the container solves the problem of disposal of the closure member since it can be removed only by pressing it into the interior of the container.

A further and significant feature of the invention is that the internal pressure within the container is relied upon not only to effect a seal between the closure member and the sealing ring, but also to apply to the closure member sufficient outwardly directed force so as to prevent the inward displacement of the closure member under normal conditions of handling and attempted openings. On the other hand, once the pressure within the container is removed, the closure member may be easily pushed into the container.

In order that the container may be readily opened, a significant feature of the invention is the provision of a lever or pull member which is connected to the sealing ring and which is operative to twist the sealing ring and effect relative displacement between the sealing ring and the closure member in a localized place sufficient to release the seal so as to vent the internal pressure within the container to the atmosphere without damaging the sealing ring for its function as a protective guard for the edge of the container.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
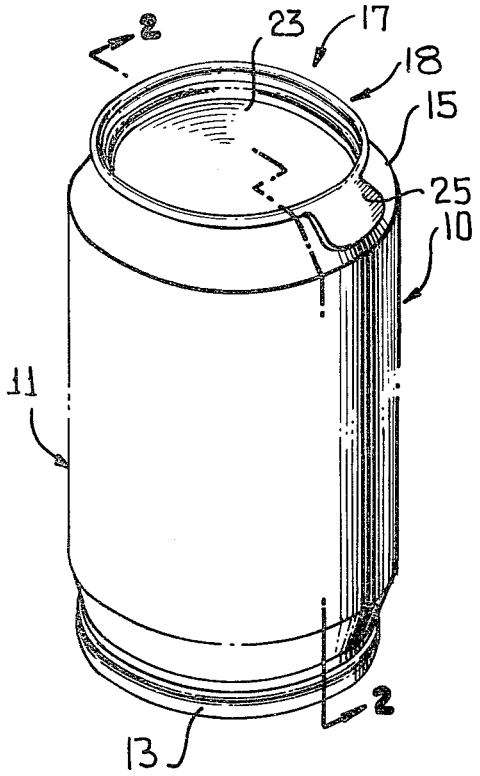
FIG. 1 is a top perspective view of a can formed in accordance with this invention.

Referring now to the drawings in detail, it will be seen that there is illustrated in FIG. 1 an easy opening container formed in accordance with this invention, the container being generally identified by the numeral 10. The container 10 includes a container body, generally identified by the numeral 11. The container body 11 is of a tubular configuration and has a lower end closed by an end unit 12 secured thereto by means of a conventional seam 13.

Figure 3:
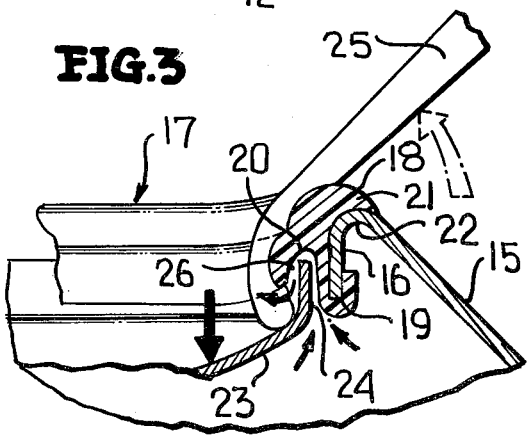
FIG. 3 is an enlarged fragmentary vertical sectional view taken through a portion of the easy opening closure, and shows the manner in which the sealing ring may be distorted so as to effect a venting of the internal pressure within the container.

The container body 11 includes a generally cylindrical primary portion 14 which terminates at its upper end in a necked-in upper portion 15 which is of a generally frustoconical configuration. The upper free end of the body 11 terminates in a radially inwardly and axially inwardly turned cylindrical flange 16, as is best shown in FIG. 3. The flange 16 generally defines a dispensing opening and carries the easy opening closure which is the subject of this invention, the closure being generally identified by the numeral 17.

The closure 17 includes a sealing ring 18 which is formed of a suitable resilient plastics material and is generally S-shaped in configuration. The sealing ring 18 thus defines a radially outer, axially outwardly directed annular channel 19 and a radially inner, axially inward directed annular channel 20 disposed in side-by-side relation. The channel 19 receives therein the free edge of the annular flange 16 and thus functions as a protective guard for that free edge. The sealing ring 18 further includes an axially outwardly and radially outwardly directed portion 21 which is engaged over and partially around a reverse bend portion 22 of the container body 11, the reverse bend portion 22 being disposed between the necked-in portion 15 and the flange 16. The portion 21 together with the channel 19 defining a generally C-shaped cross section which forms a permanent sealing interlock between the sealing ring 18 and the container body.

At this time it is pointed out that the sealing ring 18, in addition to its function of guarding the edge of the flange 16, also serves to define the dispensing opening in the container 10.

The dispensing opening is normally closed by a closure member 23 having an axially outwardly directed annular flange 24. The flange 24 is proportioned so as to seat in the channel 20. The closure member 23 is preferably axially inwardly domed as is clearly shown in FIG. 2 so as to be rigid.

It is to be understood that there is a sufficient mechanical interlock between the closure member 23 and the sealing ring 18 so that not only is the closure member 23 mechanically held in place, but also an initial seal is formed between the closure member and the sealing ring. Thus, prior to the securement of the end unit 12, the container 10 may be inverted and filled without the beverage placed therein leaking out through the closure 17. After the container 10 is filled and internally pressurized, it is closed by the end unit 12 in the normal manner. The internal pressure within the container 10 acts on the closure member 23 to urge it axially outwardly, thereby forcing it into more intimate sealing engagement with the sealing ring 19 and assuring a proper seal even under the high pressure conditions in a container filled with a carbonated beverage.

It will be readily apparent that due to the high pressure within the container and because of the diameter of the closure member 23, forces as high as 200 pounds serve to hold the closure member 23 in place. Thus, the closure member cannot be accidentally dislodged except under extremely abnormal conditions. Even then, there will normally be a controlled venting of the internal pressure before the closure member is sufficiently removed so as to prevent an undue spurting out of the contents of the container.

Figure 2:
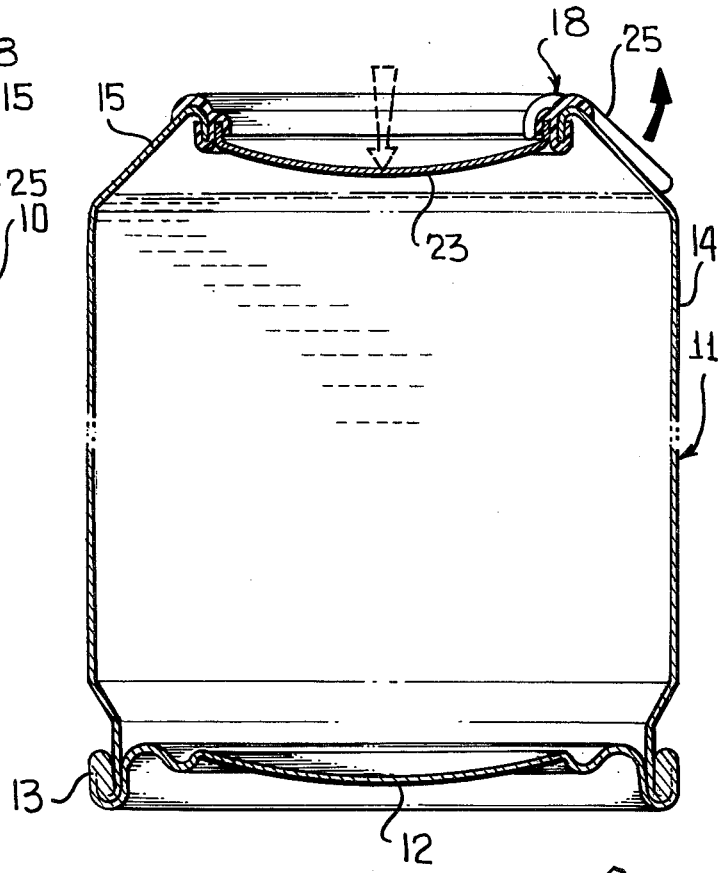
FIG. 2 is an enlarged vertical sectional view taken generally along the line 2—2 of FIG. 1 with an intermediate portion of the container body being broken away, and shows the specific details of the easy opening closure feature of the container.

In order that the container 10 may be opened, it is necessary to vent the internal pressure. To this end there is provided a lever or pull member 25 which is preferably integrally formed with the sealing ring 18, but could be separately formed and attached thereto. The lever 25 extends radially outwardly and axially downwardly from the sealing ring 18 and overlies the necked-in portion 15 as is best shown in FIGS. 1 and 2. Thus, the lever 25 in no way prevents proper stacking of the containers 11.

When it is desired to open the container 11, the lever 25 is lifted in the manner shown in FIG. 3 with the resultant distortion of the sealing ring 18 and the localized unseating of the closure member 23 relative to the sealing ring 18 so as to provide a vent passage 26 around the flange 24 as shown in FIG. 3. Once the internal pressure within the container 11 has been vented, the mechanical interlock between the flange 24 and the sealing ring 18 may be readily overcome by an axially inwardly directed pressure or force exerted on the closure 23 as indicated by the arrow in FIG. 2, with the result that the closure member 23 will be forced into the interior of the container 10 and the opening process is thus completed with no part of the container being detached therefrom during the opening process. At the same time, the sealing ring 18 remains in place to function as a guard for the raw edge of the container component defining the dispensing opening.

Figure 4:
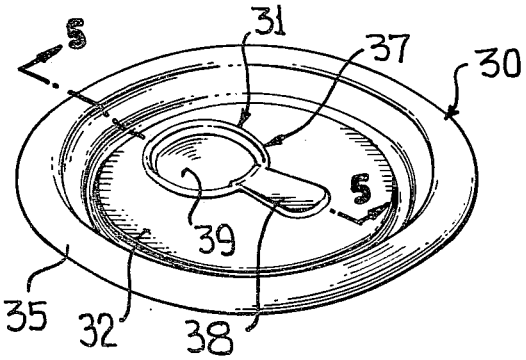
FIG. 4 is a top perspective view of an end unit employing the easy opening feature of this invention.
Figure 5:
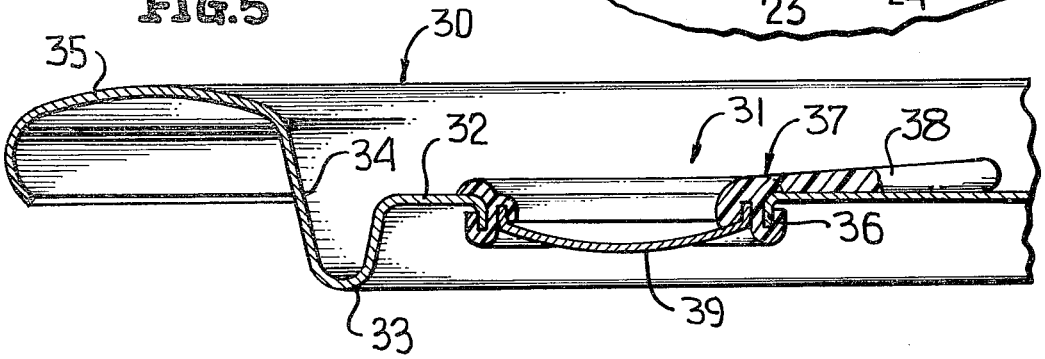
FIG. 5 is an enlarged fragmentary sectional view taken generally along the line 5—5 of FIG. 4, and shows more specifically the details of the easy opening closure.

Referring now to FIGS. 4 and 5, it will be seen that there is illustrated an end unit, generally identified by the numeral 30, the end unit 30 except for its closure, which is generally identified by the numeral 31, may be a conventional end unit.

The end unit 30 may include an end panel 32 defined by a shock absorbing bead 33 which is disposed radially inwardly of a chuck wall 34. The peripheral portion of the end unit 30 may be in the form of a curl 35 for engagement with a flange of a container body to facilitate the formation of a conventional double seam securing the end unit 30 to a container body.

Like the closure 17, the dispensing opening is generally defined by an axially inwardly directed or turned flange 36. However, the flange is part of the end panel 32 in which the dispensing opening is formed. A sealing ring, generally identified by the numeral 37, is carried by the flange 36. The sealing ring 37 is identical to or substantially identical to the sealing ring 18 except that in most instances it will be of a smaller diameter due to the smaller size of the dispensing opening defined by the flange 36. The sealing ring 37 will be provided with an opening lever or pull member 38 which, except for the fact that it lies flat on the end panel 32, will be identical to the lever 25.

The closure 31 also includes a closure member 39 which is identical to the closure member 23 except, once again, for the question of a probable reduction in size.

Inasmuch as the closure 31 is identical to the closure 17, no further discussion with respect thereto is required except to state that when the lever 38 is lifted the sealing ring 37 will be so distorted as to interrupt the seal between the sealing ring 37 and the closure member 39, thus to vent the internal pressure within an associated container, after which the closure member 39 may be readily pressed into the interior of the container to complete the opening process. Normally in the case of the closure 31, the dispensing opening will be in the form of a pour opening and, if necessary, a suitable vent opening (not shown) may also be provided.

Although the dispensing openings have been illustrated as being circular in outline and that configuration is preferred for purposes of orientation of the components, among other reasons, it is to be understood that the invention is not so restricted and other configurations of dispensing openings may be utilized. For example, the dispensing opening of the end unit 30 may be of the conventional elongated tear shape configuration so as to provide for the customary combined venting and pour function.

Although only two preferred embodiments of easy opening containers have been illustrated and described herein, it is to be understood that minor modifications may be made in the easy opening container constructions without departing from the spirit and scope of the invention as defined by the appended claims.

I claim:

1. An easy opening container comprising a container component having a dispensing opening therein, a sealing element carried by said container component and defining said dispensing opening, and a closure element releasably retained by said sealing element, said closure element being disposed generally inwardly of the container relative to said sealing element with said sealing element preventing movement of said closure element out of said container.

2. The easy opening container of claim 1 wherein there is a mechanical interlock between said closure element and said sealing element, said interlock opening into the interior of said container for releasing said closure element into the interior of said container.

3. The easy opening container of claim 2 wherein said container is particularly adapted for the packaging of a product under gaseous pressure, and there is a gaseous pressure seal between said seal between said sealing element and both said container component and said closure element.

4. The easy opening container of claim 3 together with opening means for distorting said sealing element and interrupting the seal.

5. The easy opening container of claim 4 together with opening means for distorting said sealing element and interrupting the seal between said sealing element and said closure element.

6. The easy opening container of claim 4 wherein said opening means is in the form of a lever fixedly connected to said sealing element.

7. The easy opening container of claim 6 wherein said lever is integrally formed with said sealing element.

8. The easy opening container of claim 1 wherein said container component has an inwardly directed peripheral flange about said dispensing opening, said closure element has an outwardly directed peripheral flange disposed in radially spaced concentric relation to said container component peripheral flange, and said sealing element being in the form of a ring having a generally S-shaped cross section.

9. The easy opening container of claim 8 wherein said sealing element defines a generally C-shaped socket receiving said container component for permanently retaining said closure element on said container component.

10. The easy opening container of claim 1 wherein said container is a container body having a necked-in terminal portion defining said dispensing opening.

11. The easy opening container of claim 1 wherein said container component is an end unit including an end panel having said dispensing opening therein.

12. The easy opening container of claim 1 wherein said container is sealed and has a product packaged therein under gaseous pressure, and said gaseous pressure forming the primary force retaining said closure element in place.

* * * * *